United States Patent [19]

Nance et al.

[11] 4,086,547

[45] Apr. 25, 1978

[54] SWITCHABLE ATTENUATOR

[75] Inventors: Jack G. Nance, Winston-Salem; James L. Owens, Clemmons; Theodore W. Robbins, Winston-Salem, all of N.C.

[73] Assignee: Western Electric Company, Inc., New York, N.Y.

[21] Appl. No.: 755,397

[22] Filed: Dec. 29, 1976

[51] Int. Cl.[2] ..... H01P 1/22

[52] U.S. Cl. ..... 333/81 R; 200/16 B; 200/16 F

[58] Field of Search ..... 333/81 A, 81 R; 200/6 BB, 6 B, 6 C, 11 D, 16 F, 254; 338/172, 173

[56] References Cited

U.S. PATENT DOCUMENTS

| | | | |
|---|---|---|---|
| 368,221 | 8/1887 | McDaniel | 200/254 |
| 936,594 | 10/1969 | Aalborg | 200/244 |
| 1,751,398 | 3/1930 | De Reamer et al. | 200/6 B |
| 1,919,039 | 7/1933 | Ritchie | 200/15 |
| 2,232,024 | 2/1941 | Genari | 200/162 |
| 2,791,647 | 5/1957 | Newcomb | 200/16 |
| 2,808,482 | 10/1957 | Zanichkowsky et al. | 200/6 A |
| 3,878,344 | 4/1975 | Lockard | 200/6 B |
| 3,894,203 | 7/1975 | Diehr | 200/6 R |
| 3,978,298 | 8/1976 | Fukuda et al. | 200/6 R |
| 4,025,747 | 5/1977 | Bharteey et al. | 200/254 |

*Primary Examiner*—Alfred E. Smith
*Assistant Examiner*—Harry E. Barlow
*Attorney, Agent, or Firm*—J. B. Hoofnagle, Jr.

[57] ABSTRACT

A switchable attenuator assembly includes a housing, a plurality of rocker arms mounted for pivotable movement within the housing, and a pair of shorting bars associated with each rocker arm. Each shorting bar of the pair of shorting bars associated with each rocker arm is coupled to a respective end of the rocker arm and is aligned with electrical connectors which extend from an attenuator circuit aligned with and adjacent to the housing. The rocker arms are selectively pivoted to cause the shorting bars coupled thereto to move into and out of engagement with their respective electrical connectors to provide attenuation of selected magnitudes to an external circuit.

11 Claims, 5 Drawing Figures

SWITCHABLE ATTENUATOR

BACKGROUND OF THE INVENTION

1. Field of the Invention

This invention relates to a switchable attenuator and more particularly to a switchable attenuator utilizing a pivotable rocker arm assembly and resilient connectors for providing attenuation of preselected magnitudes to an external circuit.

2. Description of the Prior Art

In numerous prior art attenuator structures it has been common to provide attenuation to an external circuit utilizing a slideable attenuator assembly. The slideable attenuator assembly ordinarily includes a slideable arm having conductive contact members at each end thereof. The conductive contact members are selectively engageable with switching contact pads connected to circuits on an attenuator circuit substrate to establish circuit paths on the substrate and thereby provide attenuation in the external circuit.

The very nature of the slideable attenuator assembly design requires that the conductive members and contact pads be engageable on the planar surface of the attenuator circuit. As a result, a large amount of space is required in the plane of the circuit to accommodate switching. In addition, utilizing this arrangement makes it necessary to provide switching contact pads which are made of conductive materials which insure very high reliability. Materials of this nature are required to insure the integrity of the electrical connections established between the conductive contact members and the switching contact pads. This requirement is most often satisified by utilizing very precious conductive materials such as, for example, rhodium and/or gold to form the switching contact pads. The space requirements and the quantity of precious conductive materials that must be used results in an expensive attenuator structure. Accordingly, it is desirable to provide a reliable attenuator structure which does not require the space and quantity of conductive materials required in manufacturing the aforementioned attenuator structure.

SUMMARY OF THE INVENTION

A switchable attenuator assembly for providing attenuation to an external circuit in accordance with certain principles of this invention includes circuit means having circuits formed thereon which establish predetermined amounts of attenuation and means for selectively coupling selected circuits on the circuit means to establish the predetermined amounts of attenuation. A plurality of connector means are each provided with a first portion electrically securable to the circuit means for providing connections to the circuits on the circuit means. Each of the plurality of connector means has a second portion aligned to receive a portion of the coupling means for providing connections between the circuit means and the coupling means.

Upon selective movement of the coupling means into engagement with the respective second portions of selected ones of the plurality of connector means, selected circuits on the circuit means are coupled to establish predetermined amounts of attenuation. Each of the plurality of connector means includes a third portion electrically securable to the external circuit for providing connections between the circuit means and the external circuit so that the predetermined amounts of attenuation established in the circuit means by selected movement of the coupling means are provided to the external circuit.

BRIEF DESCRIPTION OF THE DRAWING

Advantages of the present invention will be apparent from the following detailed description when considered in conjunction with the accompanying drawing in which.

DETAILED DESCRIPTION

Figure 1:
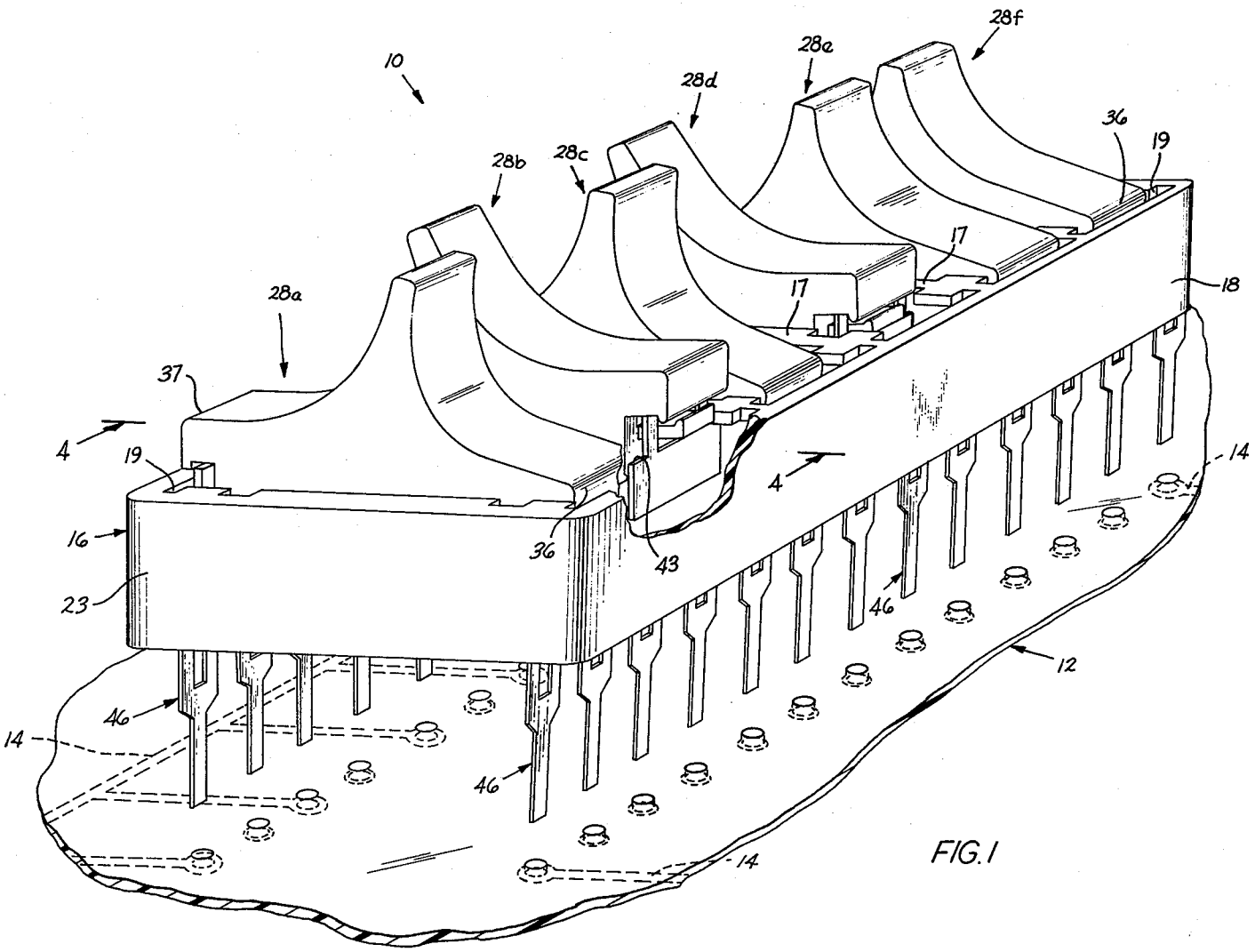
FIG. 1 is an enlarged isometric view of a switchable attenuator assembly embodying certain principles of the invention.

Referring to FIG. 1, a switchable attenuator assembly, generally designated by the numeral 10, is arranged to be electrically coupled to an external circuit supported, for example, on a printed circuit board generally designated by the numeral 12. The printed circuit board 12 has conductive paths 14—14 formed therewith which are electrically coupled to circuitry (not shown) included on the printed circuit board and form a portion of the external circuit.

Figure 2:
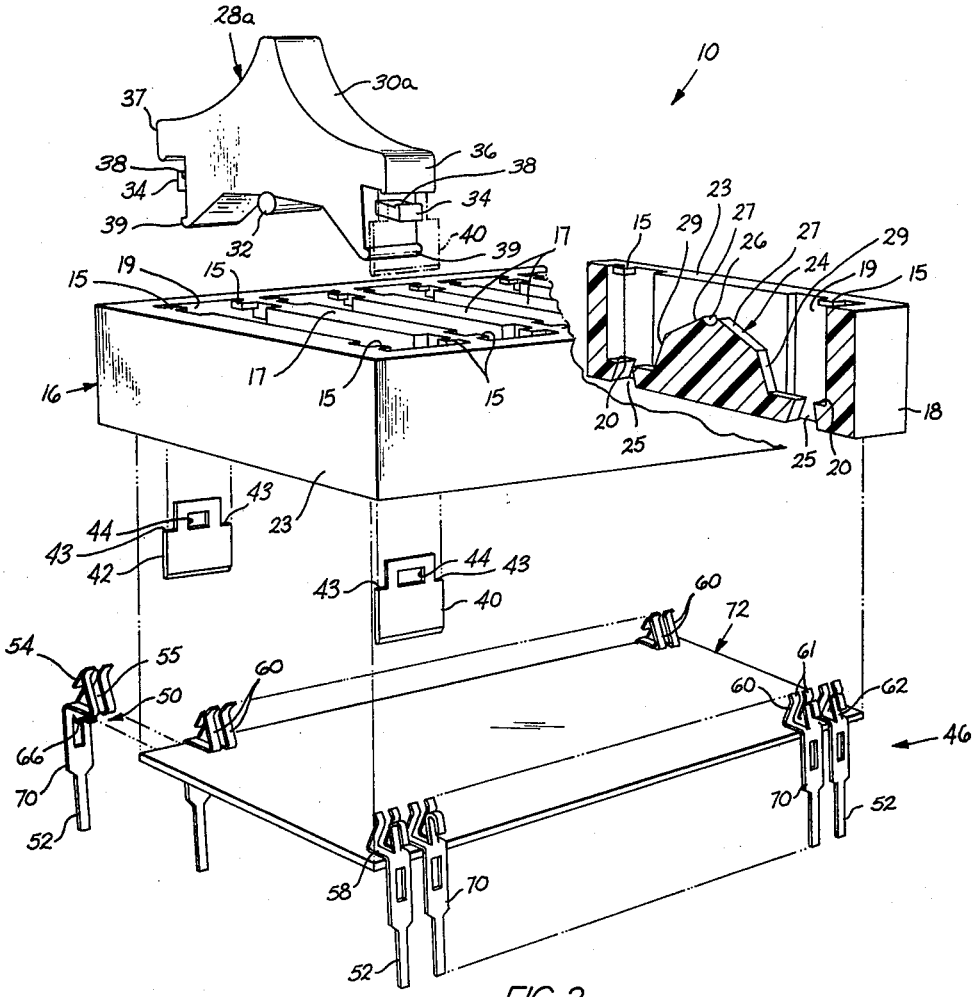
FIG. 2 is an exploded isometric view of the attenuator assembly illustrated in FIG. 1.
Figure 4:
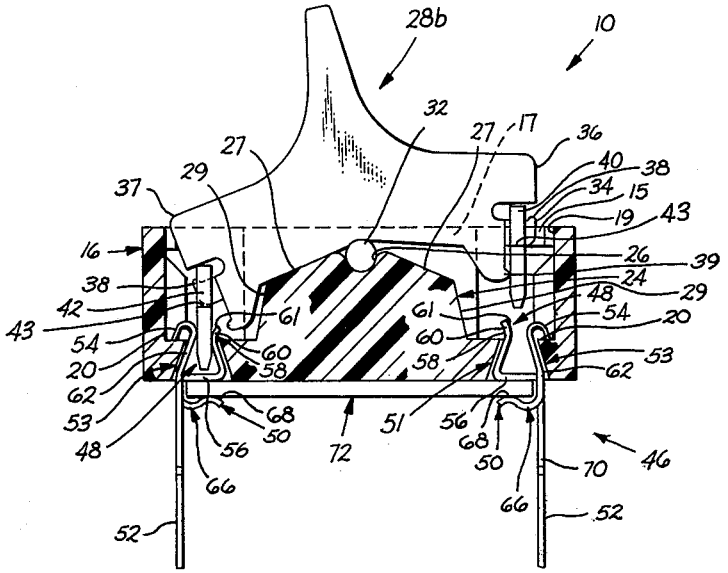
FIG. 4 is a cross-sectional view taken along line 4—4 of FIG. 1 showing portions of the attenuator assembly illustrated in FIG. 1.

As illustrated in FIGS. 1, 2 and 4, the switchable attenuator assembly 10 includes a housing, generally designated by the numeral 16, which has a plurality of spaced rib members 17, having projections 15 formed at opposite ends on opposite sides thereof, extending between two opposed side walls 18 of the housing to form openings 19—19 in the housing. Elongated supporting ledges 20 (FIGS. 2 and 4) are formed internally on each of the two opposed side walls 18 of the housing 16 and extend along the length of the side wall between opposed spaced end walls 23 of the housing. A central partition, generally designated by the numeral 24, is formed in the housing 16 between the opposed spaced end walls 23 and is located between and spaced from the side walls 18—18 to form a pair of spaces 25 (FIG. 2) between the partition and each side wall of the housing. The central partition 24 has a groove 26 formed therein which extends the length of the partition with successive portions of the groove laterally straddling the inner portions of the spaced openings 19. The central partition 24 is also formed with a pair of upper surfaces 27 (FIGS. 2 and 3) which slope downwardly from opposite sides of the groove 26 and is also formed with cutouts 29 at the base of the sloping upper surfaces.

A plurality of identical rocker arms (FIG. 1), generally designated by the numerals **28*a*–28*f*, are included in the attenuator assembly 10 and are insertable into the housing 16 with top portions 30*a*–30*f* thereof extending upwardly through corresponding ones of the openings 19 in the housing. The rocker arms 28*a* through 28*f* (FIG. 1) are identical in structure, for example, as illustrated in FIG. 2 with respect to rocker arm 28*a*. Rocker arm 28*a* has a shaft 32 formed integrally therewith which rests in a corresponding portion of the groove 26 of the partition 24. A pair of lugs 34 are formed integrally with and extend laterally from recessed end walls of the rocker arm 28*a*. Overhanging ends 36 and 37 of the rocker arm 28a are spatially located above the lugs 34. Each lug 34 is formed with a raised lip 38 at the free end thereof. Protruding members 39 are formed integrally with each end wall of the rocker arm 28a and are spatially located below the lugs 34**.

A pair of shorting bars or blades 40 and 42 (FIG. 2) each have a pair of spaced shoulders 43 and an opening 44 formed therein. The opening 44 of the shorting bars 40 and 42 are provided to receive the lugs 34 of the rocker arm 28a to allow the shorting bars to rest on the lugs and be seated on the rocker arm as is illustrated by the shorting bar 40 shown in phantom in FIG. 2. The raised lips 38 of the lugs 34 preclude the shorting bars 40 and 42 from sliding off the lugs once the shorting bars are positioned on the lugs. Once the shorting bars 40 and 42 are positioned on the lugs 34, the lower portion of the shorting bar is maintained in proper vertical alignment by the respective protruding members 39 as illustrated by the lug 40 in FIG. 4. The shorting bars 40 and 42 can be formed of any reliable conductive material such as, for example, copper. The shorting bars 40 and 42 may also have another conductive material, such as, for example, gold, added to portions thereof to enhance the electrical coupling capabilities of the shorting bars.

Figure 3:
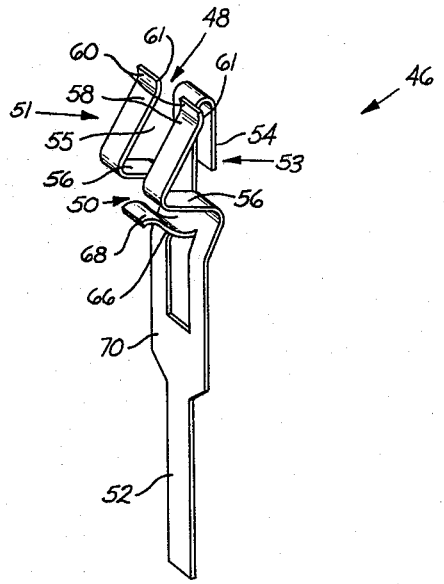
FIG. 3 is an isometric view illustrating a connector embodying certain principles of the invention.

Referring to FIGS. 2 and 3 and 4, a plurality of integral dual clip electrical connectors, generally designated by the numeral 46, are provided for facilitating electrical coupling in the attenuator assembly 10. A connector of this type also is disclosed in the copending application of J. L. Owens and entitled "Dual Clip Connector," Ser. No. 755,399 which was filed concurrently herewith and is assigned to the same assignee. Referring to FIG. 3, each connector 46, which is formed of a conductive material such as, for example, a copper-nickel alloy, includes first and second electrical clips, generally designated by the numerals 48 and 50, respectively, and a conductive stem 52. The first clip 48 includes a pair of spaced resilient side fingers, generally designated by the numeral 51, which lie in a first plane and an opposed central resilient finger, generally designated by the numeral 53, which lies in a second plane spaced from the first plane. The central finger 53 is formed with an outwardly turned retaining hook 54. The central finger 53 is aligned with and spaced from a space 55 between the pair of resilient side fingers 51. The resilient side fingers 51 each includes a portion 56 which extends laterally from the plane of the stem 52 at an upper end thereof and another portion 58 which extends generally upwardly from the portion 56 with the upper end of the portion 58 angled toward the plane of the stem 52. The inner surfaces of the outwardly turned free ends 60 of the upwardly extending arms 58 can be coated with a highly conductive material such as, for example, gold to provide contact pads 61 which will enhance electrical coupling. The central finger 53 cooperates with the upwardly extending arms 58 of the fingers 51 to receive and retain a respective one of the shorting bars 40 or 42 therebetween. The retaining hook 54 of the central finger 53 is provided to cooperate with the support ledge 20 of the housing 16 to retain the connector 46 in the housing.

A laterally extending resilient finger, generally designated by the numeral 66, of each connector 46, which includes a circuit contact portion 68, is formed from an intermediate portion 70 of the stem 52. The laterally extending finger 66 cooperates with the laterally extending arms 56 of the pair of fingers 51 to form the second electrical clip 50.

Referring again to FIGS. 1 and 2, a circuit substrate device, generally designated by the numeral 72, is included in the attenuator assembly 10, to provide predetermined amounts of attenuation to the external circuit. The circuit substrate device 72 may be constructed utilizing discrete components or fabricated utilizing printed circuit techniques, thin film technology or any other well-known circuit fabrication techniques.

Figure 5:
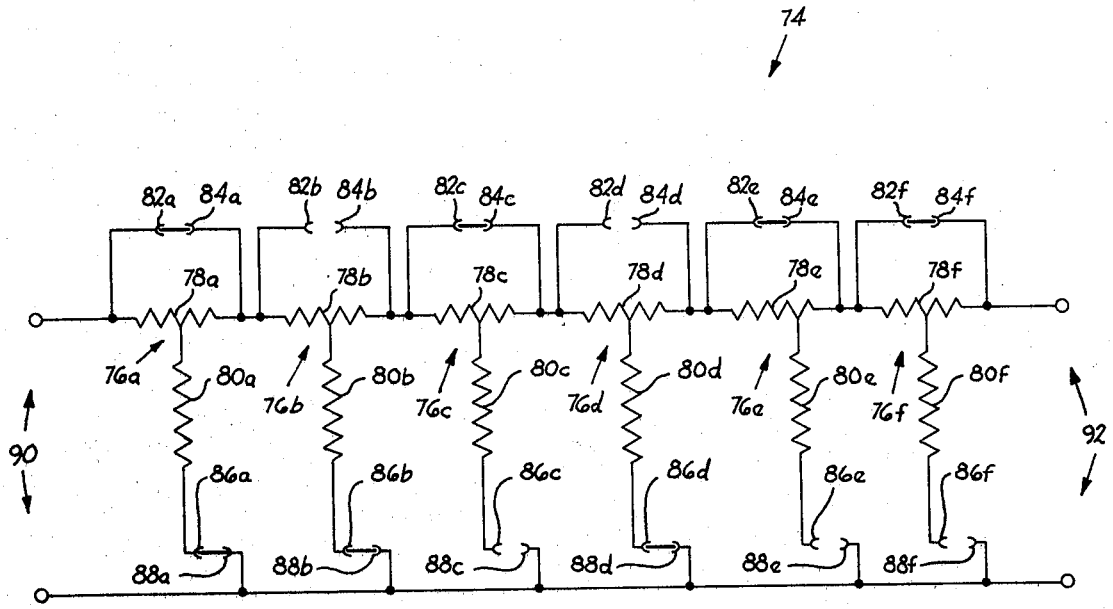
FIG. 5 is a circuit schematic illustrating a circuit on a circuit substrate.

The underside of the circuit substrate device 72 includes a circuit generally designated by the numeral 74 (FIG. 5). The circuit 74 includes a plurality of resistive T-networks, generally designated by the numerals 76a–76f, each of which provide a designated amount of attenuation at a predetermined impedance. The amount of attenuation provided by each of the resistive T-networks 76a–76f will depend on the value of resistors 78a–78f and 80a–80f, included in each network.

The connectors 46 are connectable to the circuit substrate device 72 via the second electrical clips 50 in an array on opposite sides of the device as illustrated in FIGS. 2 and 4. The contact surfaces 68 of the connectors 46 are located so as to electrically engage respective nodes 82a–82f, 84a–f, 86a–f and 88a–f (FIG. 5), of each of the resistive T-networks 76a–76f. The stems 52 of those connectors 46 which are coupled to the nodes 82a–82f, 84a–84f, 86a–86f and 88a–88f, can ultimately be coupled to corresponding conductive paths 14 (FIG. 1) on the external circuit. This connects an input and output 90 and 92 (FIG. 5), respectively, of the circuit 74, to the external circuit so that selected amounts of attenuation can be provided thereto.

As is illustrated in FIG. 4, when the attenuator assembly 10 is assembled, the shafts 32 of the rocker arms 28a–28f are supported in corresponding portions of the groove 26 of the central partition 24 to provide for pivotable movement of the rocker arms within the housing 16. The bottom surface of the rocker arms 28a–28f and the angled upper surfaces 27 of the partition 24 cooperate so that when the rocker arms are pivoted the underside of the rocker arms will engage the angled upper surfaces of the partition to limit the travel of the rocker arms. In addition, the cutouts 29 provide space for movement of the portion of the rocker arms 28a–28f which contain the protruding members 39 as illustrated to the left of FIG. 4. The shorting bars 40 and 42 are assembled with the rocker arms 28a–28f from the underside of the housing 16 on the lugs 34 on each end 36 and 37, respectively, of the rocker arms to hang freely on the lugs as previously noted. The rocker arms 28a–28f are positioned so that the shoulders 43 are aligned to engage the corresponding projections 15 on the respective rib members 17. As a result, when the rocker arms 28a–28f are pivoted, the shoulders 43 thereof will engage the respective projections 15 thereby precluding the rocker arms from coming out of the housing 16.

The circuit substrate device 72 is located adjacent the housing 16 so that the shorting bars 40 and 42 associated with ends 36 and 37, respectively, of the rocker arms 28a–28f will be aligned to engage the corresponding clips 48 of the adjacent pairs of connectors 46 coupled to the nodes 82a–82f, 84a–84f, 86a–86f and 88a–88f of the circuit 74 on the circuit substrate device. The connectors 46 are positioned in the spaces 23 so that retaining hooks 54 of the connectors 46 engage and rest on corresponding portions of the ledges 20 of the housing 16. This results in the connectors 46 and the circuit substrate 72 being assembled with the housing 16 so that the pairs of connectors are in alignment with their respective shorting bars 40 and 42 attached to the rocker arms 28*a*–28*f*. Further, since one or the other of the shorting bars 40 or 42 on each of the rocker arms 28*a*–28*f* is always engaged in its respective connector 46, as will be subsequently described, the shorting bar will function to retain one or the other shorting bar and the rocker arm in operative position in the housing on the central partition 24.

When a desired amount of attenuation is to be provided to the external circuit 12, the appropriate rocker arms 28*a*–28*f* of the attenuator 10 assembly must be pivoted such as, for example, the rocker arm 28*b* illustrated in FIGS. 1 and 4. When the rocker arm 28*b* is pivoted in the direction indicated, the associated shorting bar 42 (FIGS. 2 and 4) coupled to its downwardly directed end 38 (FIGS. 2 and 4) will engage the clips 48 of the adjacent pair of connectors 46 aligned therewith and coupled to the nodes 86*b* and 88*b* (FIG. 5) of the resistive T-network 76*b*. This will establish a connection between the nodes 86*b* and 88*b*, thereby establishing a current path through a portion of the resistor 78*b* and the resistor 80*b* to the external circuit 12. At the same time, the shorting bar 40 on the end 36 of the rocker arm 28*b* disengages from its respective nodes 82*b* and 84*b* (FIG. 5). As a result, a predetermined amount of attenuation will be provided in the external circuit 12. Similarly, each of the rocker arms 28*a* and 28*c*–28*f*, when pivoted in the direction of the rocker arm 28*b*, will cause the shorting bar 42 associated with the downwardly directed end 37 of the rocker arm to establish a connection between the corresponding nodes 86*a* through 86*f* associated therewith to thereby provide predetermined amounts of attenuation to the external circuit 12.

Attenuation may be removed from the external circuit 12 by pivoting the rocker arms 28 in the other direction, such as, for example, as is illustrated by rocker arm 28*a* in FIG. 1. Pivoting of the rocker arm 28*a* as illustrated will open the connection between the nodes 86*a* and 88*a* (FIG. 5) for the resistor 80*a* by removing the shorting bar 42 (FIG. 4) from engagement with its associated clips 48 while simultaneously causing the shorting bar 40 (FIG. 4) coupled to the ends 36 of the rocker arm to engage the clips 48 of the connectors 46 coupled to the nodes 82*a* and 84*a* (FIG. 5). This will short out the resistor 78*a* (FIG. 5) of the resistive T-network 76*a*. As a result, attenuation provided by the resistive T-network 76*a* will be removed from the external circuit 12. The other rocker arms 28*b*–28*f* may be pivoted in a similar manner to remove the respective amounts of attenuation provided by the resistive T-networks 76 associated therewith from the external circuit 12.

It should be understood that additional attenuation may be provided to the external circuit 12 by including additional resistive T-networks such as, for example, resistive T-networks 76*a* in the circuit 74 and providing the corresponding structural components that are required.

It is to be understood that the above-described embodiment is simply illustrative of this invention and that other embodiments thereof may be devised by those skilled in the art which will embody the principles of the invention and fall within the spirit and scope thereof.

What is claimed is:

1. An attenuator for providing attenuation in an external circuit comprising:

circuit means having circuits formed thereon for establishing attenuation;

means for selectively coupling selected circuits on the circuit means;

a plurality of electrical connector means;

each of the plurality of electrical connector means having a first portion electrically securable to the circuit means for providing connections to the circuits on the circuit means;

each of the plurality of electrical connector means having a second portion engageable by electrically conductive portions of the coupling means for providing connections between the circuit means and the coupling means so that upon selective engagement of the coupling means and the second portions of selected ones of the plurality of electrical connector means, selected circuits on the circuit means are coupled to establish predetermined amounts of attenuation; and each of the plurality of electrical connector means having a third portion selected ones of which are electrically securable to the external circuit for providing connections between the circuit means and the external circuit so that predetermined amounts of attenuation established by the circuit means are provided in the external circuit.

2. An attenuator as defined in claim 1 further comprising a housing for receiving and containing portions of the coupling means and the electrical connector means.

3. An attenuator as defined in claim 2 wherein the coupling means includes a rocker arm pivotably mounted for movement in the housing and with the associated electrically conductive portions of the coupling means being mounted on the rocker arm for engaging the second portions of the corresponding electrical connector means to couple selected circuits on the circuit means upon selected movement of the rocker arm.

4. An attenuator as defined in claim 3 wherein the electrically conductive portions on the rocker arm include a pair of electrically conductive shorting bars, and wherein each of the pair of shorting bars is coupled to a respective end of the rocker arm.

5. An attenuator as defined in claim 4 wherein the circuits on the circuit means include a resistive T-network which provides a designated amount of attenuation at a predetermined impedance, and wherein one shorting bar completes an electrical path in the resistive T-network to provide one level of attenuation in the external circuit and wherein the other shorting bar shorts out a portion of the resistive T-network to provide another level of attenuation in the external circuit.

6. An attenuator as defined in claim 1 wherein:

the first portions of each of the plurality of electrical connector means include a first electrical clip;

the second portions of each of the plurality of electrical connector means include a second electrical clip; and the third portions of each of the plurality of electrical connector means include an electrical stem which is coupled to the first and second electrical clips.

7. An attenuator as defined in claim 6 wherein the first electrical clip includes portions forming a part of the second electrical clip.

8. An attenuator as defined in claim 7 wherein the first electrical clip includes a laterally extending finger formed on an intermediate portion of the electrical connector means which is in spaced relationship to the portions of the first electrical clip which forms a part of the second electrical clip.

9. An attenuator as defined in claim 8 wherein the second electrical clip of each electrical connector means includes a pair of upwardly extending side fingers and a central finger aligned with a space between the upwardly extending side fingers, the central finger and the upwardly extending side fingers cooperating to receive the electrically conductive portions of the coupling means to provide the connections between the circuit means and the coupling means.

10. An attenuator as defined in claim 9 wherein the second electrical clip further includes a pair of laterally extending fingers coupled to and supporting the upwardly extending side fingers and wherein portions of the pair of laterally extending fingers cooperate with the laterally extending finger formed on the intermediate portion of the connector means to provide the connections to the circuits on the circuit means.

11. An attenuator for providing attenuation in an external circuit comprising:

a substrate having circuits formed thereon for establishing predetermined amounts of attenuation in the external circuit;

a housing having openings formed therein;

a partition formed in the housing;

a plurality of rocker arms mounted for movement on the partition and having upper portions thereof extending through the openings in the housing;

a plurality of pairs of conductive shorting bars with one bar of each of the pairs of bars mounted to a respective end of each rocker arm for coupling selected circuits on the substrate; and a plurality of pairs of electrical connectors, one pair for each of the shorting bars, mounted on the housing on opposite sides of the partition;

each of the plurality of electrical connectors including first and second side fingers and a central finger aligned with a space between the first and second side fingers and cooperating therewith to receive a respective one of the conductive shorting bars;

each of the plurality of electrical connectors including a third projecting finger formed on an intermediate portion of the connector which cooperates with portions of the first and second side fingers to receive and retain the substrate in a position adjacent the housing and provide connections to the circuits on the substrate, and thereby provide a connection between the substrate and the shorting bar so that upon the selective movement of the rocker arms selected circuits on the substrate are coupled to establish predetermined amounts of attenuation;

each of the plurality of electrical connectors including a conductive stem selected ones of which provide connections between the substrate and the external circuit so that the predetermined amounts of attenuation established by the substrate are provided to the external circuit.

* * * * *